US012123294B2

(12) United States Patent
Chatar et al.

(10) Patent No.: US 12,123,294 B2
(45) Date of Patent: *Oct. 22, 2024

(54) SYSTEM AND METHOD FOR PREDICTING STICK-SLIP

(71) Applicant: Schlumberger Technology Corporation, Sugar Land, TX (US)

(72) Inventors: Crispin Chatar, Menlo Park, CA (US); Soumya Gupta, Santa Clara, CA (US); Jose R. Celaya Galvan, Menlo Park, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/432,202

(22) Filed: Feb. 5, 2024

(65) Prior Publication Data

US 2024/0175344 A1 May 30, 2024

Related U.S. Application Data

(63) Continuation of application No. 17/756,822, filed as application No. PCT/US2019/064753 on Dec. 5, 2019, now Pat. No. 11,920,454.

(51) Int. Cl.

| | |
|---|---|
| ***E21B 44/00*** | (2006.01) |
| ***E21B 47/00*** | (2012.01) |
| ***E21B 49/00*** | (2006.01) |

(52) U.S. Cl.

CPC ..... *E21B 44/00* (2013.01); *E21B 47/00* (2013.01); *E21B 49/00* (2013.01); *E21B 2200/20* (2020.05)

(58) Field of Classification Search

CPC ..... E21B 44/00; E21B 45/00; E21B 44/04; E21B 44/02; E21B 2200/20;

(Continued)

(56) References Cited

U.S. PATENT DOCUMENTS

| | | |
|---|---|---|
| 5,721,376 A | 2/1998 | Pavone et al. |
| 9,934,338 B2 | 4/2018 | Germain et al. |

(Continued)

FOREIGN PATENT DOCUMENTS

| | | |
|---|---|---|
| WO | 2014066611 | 5/2014 |
| WO | 2016108866 | 7/2016 |

OTHER PUBLICATIONS

Search Report and Written Opinion of International Patent Application No. PCT/US2019/064753 dated Aug. 31, 2020, 13 pages.

(Continued)

*Primary Examiner* — Kipp C Wallace
(74) *Attorney, Agent, or Firm* — Jeffrey D. Frantz

(57) ABSTRACT

A method for predicting a stick-slip event includes measuring one or more surface properties using a sensor at the surface. The method also includes measuring one or more downhole properties using a downhole tool in a wellbore. The method also includes determining that the one or more surface properties and the one or more downhole properties match a distribution. The distribution occurs before two or more previously-detected stick-slip events. The method also includes determining a likelihood that a stick-slip event will occur based at least partially upon the distribution that the one or more surface properties and the one or more downhole properties match.

15 Claims, 6 Drawing Sheets

(58) Field of Classification Search
CPC .... E21B 2200/22; E21B 41/00; E21B 47/007; E21B 7/04; E21B 3/022; E21B 44/005; E21B 7/00
See application file for complete search history.

(56) References Cited

U.S. PATENT DOCUMENTS

| | | | | |
|---|---|---|---|---|
| 11,920,454 | B2 | 3/2024 | Chatar et al. | |
| 2002/0120401 | A1 | 8/2002 | Macdonald et al. | |
| 2009/0114445 | A1 | 5/2009 | Dashevskiy | |
| 2011/0301924 | A1 | 12/2011 | Jeffreys | |
| 2013/0341090 | A1 | 12/2013 | Zeineddine et al. | |
| 2014/0121972 | A1 | 5/2014 | Wessling et al. | |
| 2015/0275648 | A1 | 10/2015 | Wang et al. | |
| 2016/0076354 | A1* | 3/2016 | Lai | G01L 3/1457 702/9 |
| 2016/0117424 | A1 | 4/2016 | Hohl et al. | |
| 2016/0138382 | A1 | 5/2016 | Badkoubeh et al. | |
| 2016/0290118 | A1 | 10/2016 | Xue et al. | |
| 2018/0328159 | A1* | 11/2018 | Mandava | E21B 47/10 |
| 2019/0032467 | A1 | 1/2019 | Wang et al. | |
| 2019/0284908 | A1 | 9/2019 | Dykstra et al. | |
| 2019/0284921 | A1 | 9/2019 | Xue et al. | |
| 2020/0318471 | A1 | 10/2020 | Papouras et al. | |
| 2021/0065050 | A1* | 3/2021 | Laing | G05B 23/024 |

OTHER PUBLICATIONS

International Preliminary Report on Patentability of International Patent Application No. PCT/US2019/064753 dated Jun. 16, 2022, 10 pages.

Gupta, S. et al., "Machine Learning Lessons Learnt in Stick-Slip Prediction", SPE-197584-MS, prepared for presentation at the Abu Dhabi International Petroleum Exhibition & Conference held in Abu Dhabi, UAE, 2019, 11 pages.

Extended Search issued in European Patent Application No. 19955167.2 dated Jul. 10, 2023, 9 pages.

* cited by examiner

SYSTEM AND METHOD FOR PREDICTING STICK-SLIP

CROSS-REFERENCE TO RELATED APPLICATIONS

This application is a continuation of U.S. patent application Ser. No. 17/756,822, filed Jun. 3, 2022, which is a National Stage Entry of International Application No. PCT/US2019/064753, filed Dec. 5, 2019.

BACKGROUND

Stick-slip is characterized by the absorption and release of energy as a function of a difference between static friction and dynamic friction. In the oilfield industry, stick-slip may occur to a drill string and/or a downhole tool in a wellbore. In one example, stick-slip may occur due to friction between the drill string and/or downhole tool and the side wall of the wellbore. In another example, stick-slip may occur due to friction between the drill bit and the formation through which the drill bit is cutting. The friction may cause a lower portion of the drill string and/or the downhole tool to slow down or stop rotating while an upper portion continues to be rotated by equipment at the surface. This may cause one or more turns or twists to develop in the drill string. As the turns/twists build, the rotational potential energy increases. When the rotational potential energy overcomes the friction force, the drill string and/or downhole tool slip(s), resulting in an uncontrolled rotational speed and/or rotational acceleration in the wellbore.

As will be appreciated, sticking and/or slipping may damage the drill string and/or the downhole tool (e.g., the drill bit), damage the wellbore, cause non-productive time, etc. Systems and methods exist to mitigate stick-slip after the stick-slip is detected. However, it would be desirable to have systems and methods that can predict stick-slip before it occurs.

SUMMARY

A method for predicting a stick-slip event is disclosed. The method includes measuring one or more surface properties using a sensor at the surface. The method also includes measuring one or more downhole properties using a downhole tool in a wellbore. The method also includes determining that the one or more surface properties and the one or more downhole properties match a distribution (e.g., a pattern). The distribution occurs before two or more previously-detected stick-slip events. The method also includes determining a likelihood that a stick-slip event will occur based at least partially upon the distribution that the one or more surface properties and the one or more downhole properties match.

In another embodiment, the method includes measuring one or more first surface properties. The method also includes measuring one or more first downhole properties. The method also includes training a model. Training the model includes identifying a plurality of previously-detected stick-slip events. Training the model also includes determining the one or more first surface properties and the one or more first downhole properties that occur before each of the previously-detected stick-slip events. Training the model also includes determining a distribution in the one or more first surface properties and the one or more first downhole properties that occurs before two or more of the previously-detected stick-slip events. The method also includes measuring one or more second surface properties. The method also includes measuring one or more second downhole properties. The method also includes determining that the one or more second surface properties and the one or more second downhole properties match the distribution. The method also includes determining a likelihood that a stick-slip event will occur based at least partially upon the distribution that the one or more second surface properties and the one or more second downhole properties match.

A system for predicting a stick-slip event is also disclosed. The system includes a sensor configured to measure one or more surface properties. The system also includes a downhole tool configured to measure one or more downhole properties. The system also includes a computing system configured to receive the one or more surface properties and the one or more downhole properties. The computing system is also configured to determine that the one or more surface properties and the one or more downhole properties match a distribution. The distribution occurs before two or more previously-detected stick-slip events. The computing system is also configured to determine a likelihood that a stick-slip event will occur based at least partially upon the distribution that the one or more surface properties and the one or more downhole properties match.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Figure 1:
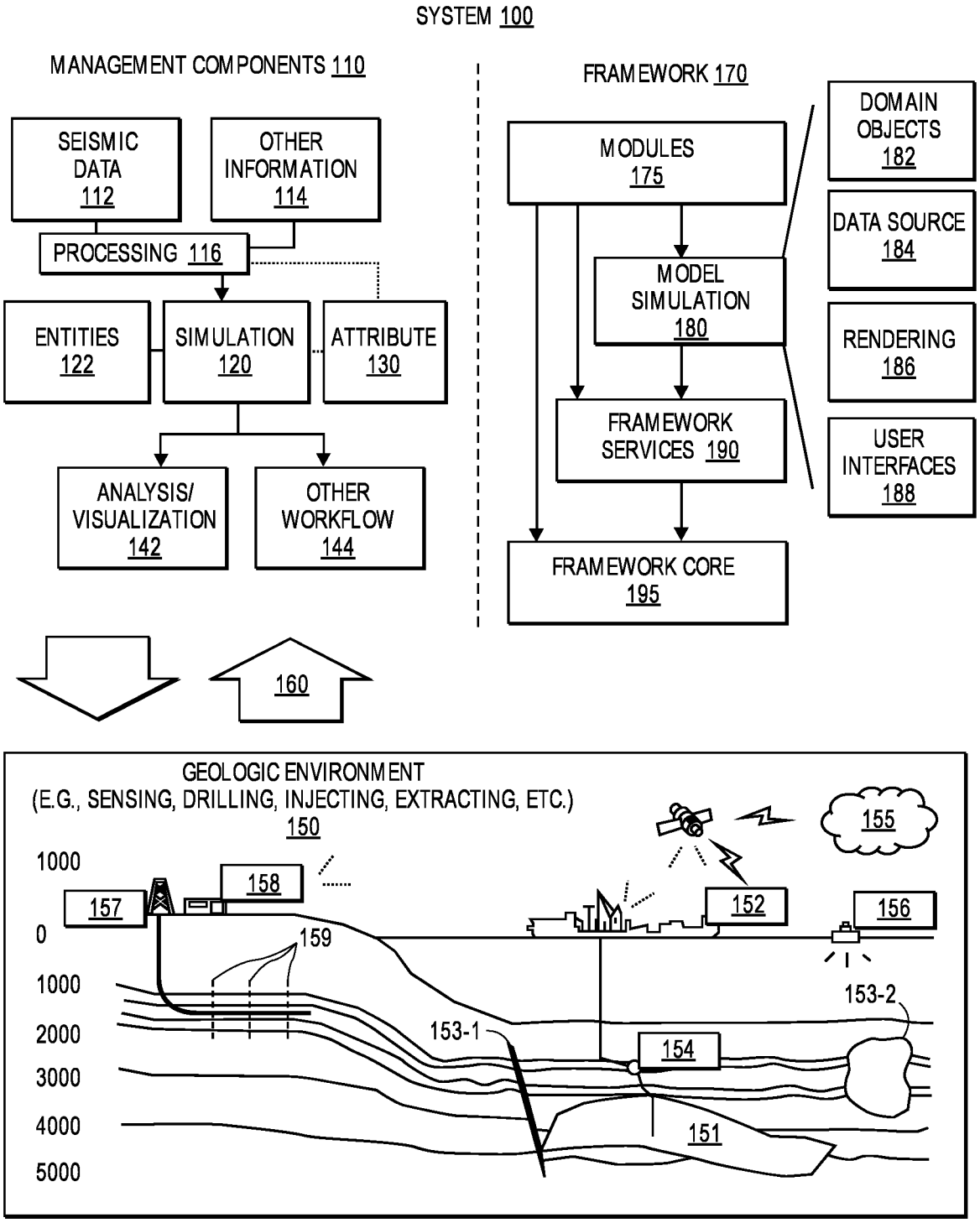
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (Schlumberger Limited, Houston Texas), the INTERSECT™ reservoir simulator (Schlumberger Limited, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (Schlumberger Limited, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Figure 2:
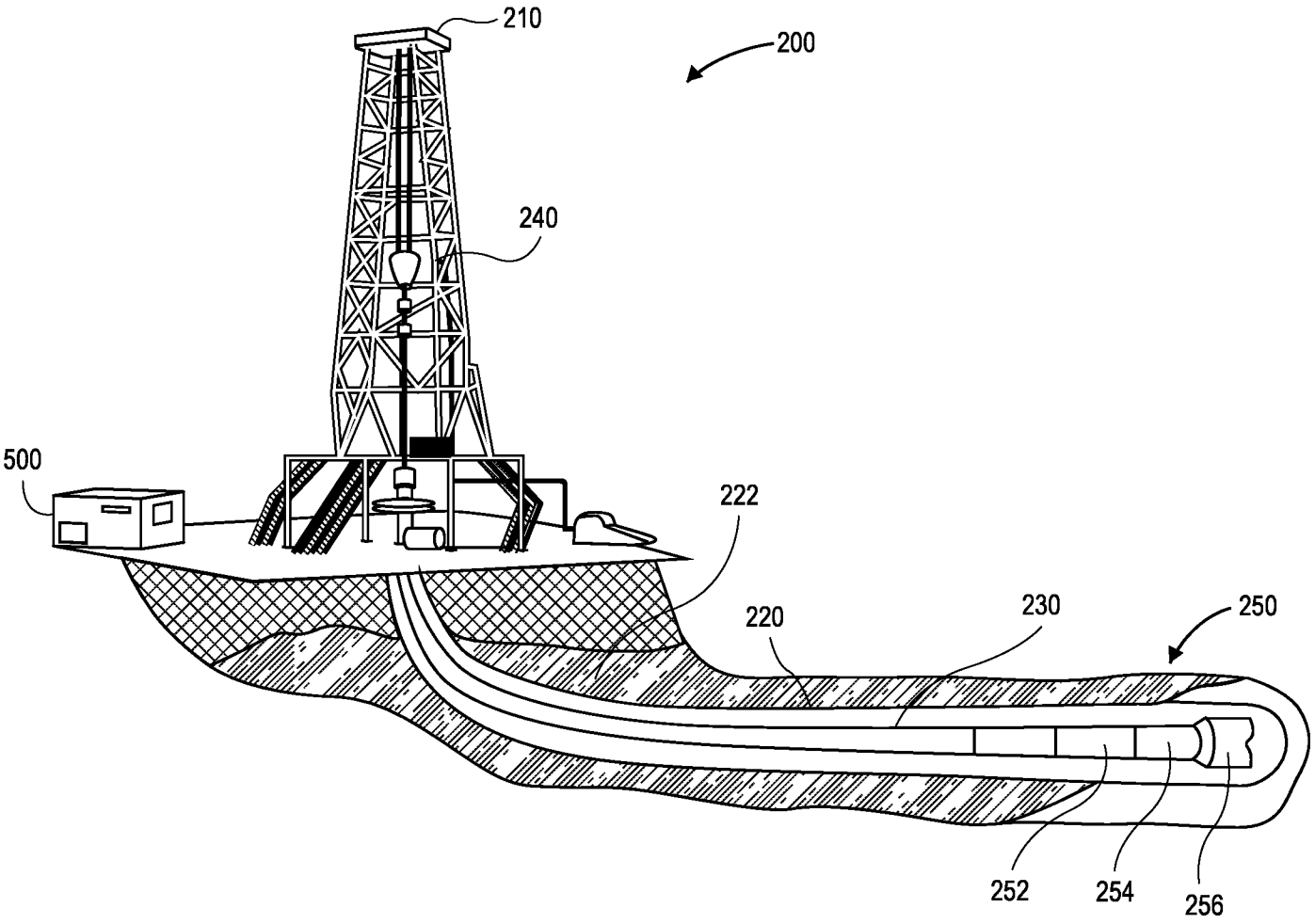
FIG. 2 illustrates a schematic view of a wellsite, according to an embodiment.

FIG. 2 illustrates a schematic view of a wellsite 200, according to an embodiment. The wellsite 200 may include a rig 210 positioned above a wellbore 220 that is formed in a subterranean formation 222. A tubular string 230 may extend from the rig 210 into the wellbore 220. In one embodiment, the tubular string 230 may be or include a drill string made of a plurality of drill pipe segments.

One or more surface sensors (one is shown: 240) may be positioned at the surface (e.g., on the rig 210). The surface sensor 240 may be configured to measure surface physical properties, such as a rate of rotation (e.g., in RPM) of the tubular string 230 at the surface. More particularly, the surface sensor 240 may be configured to measure the rate of rotation imparted to an upper portion of the tubular string 230 by the rig 210 (e.g., by a rotary table and/or kelly of the rig 210). The surface physical properties measured by the surface sensor 240 may also include a torque exerted on the upper portion of the tubular string 230 by the rig 210 (e.g., by the rotary table and/or kelly). The surface physical properties may also include a weight on a drill bit 256 (WOB). The surface physical properties may also include a depth of the drill bit 256.

A downhole tool 250 may be coupled to an end of the tubular string 230 in the wellbore 220. The downhole tool 250 may be or include a measurement-while drilling (MWD) tool 252, a logging-while-drilling (LWD) tool 254, and the drill bit 256. The MWD 252 and/or the LWD 254 may be configured to measure downhole properties as the drill bit 256 drills the wellbore 220 farther into the subterranean formation 222. For example, the downhole tool 250 (e.g., the MWD 252) may be configured to measure downhole physical properties, such as pressure, temperature, and wellbore trajectory in three-dimensional space. The downhole physical properties may also include a rate of rotation of the downhole tool 250 (e.g., referred to as CRPM). As described above, the rate of rotation of a lower portion of the tubular string 230 in the wellbore 220 and/or a rate of rotation of the downhole tool 250 in the wellbore 220 may be different than the rate of rotation imparted to the upper portion of the tubular string 230 at the surface during stick-slip conditions. The downhole tool 250 (e.g., the LWD 254) may also be configured to measure downhole formation properties, such as resistivity, porosity, sonic velocity, and gamma ray data.

Figure 3A:
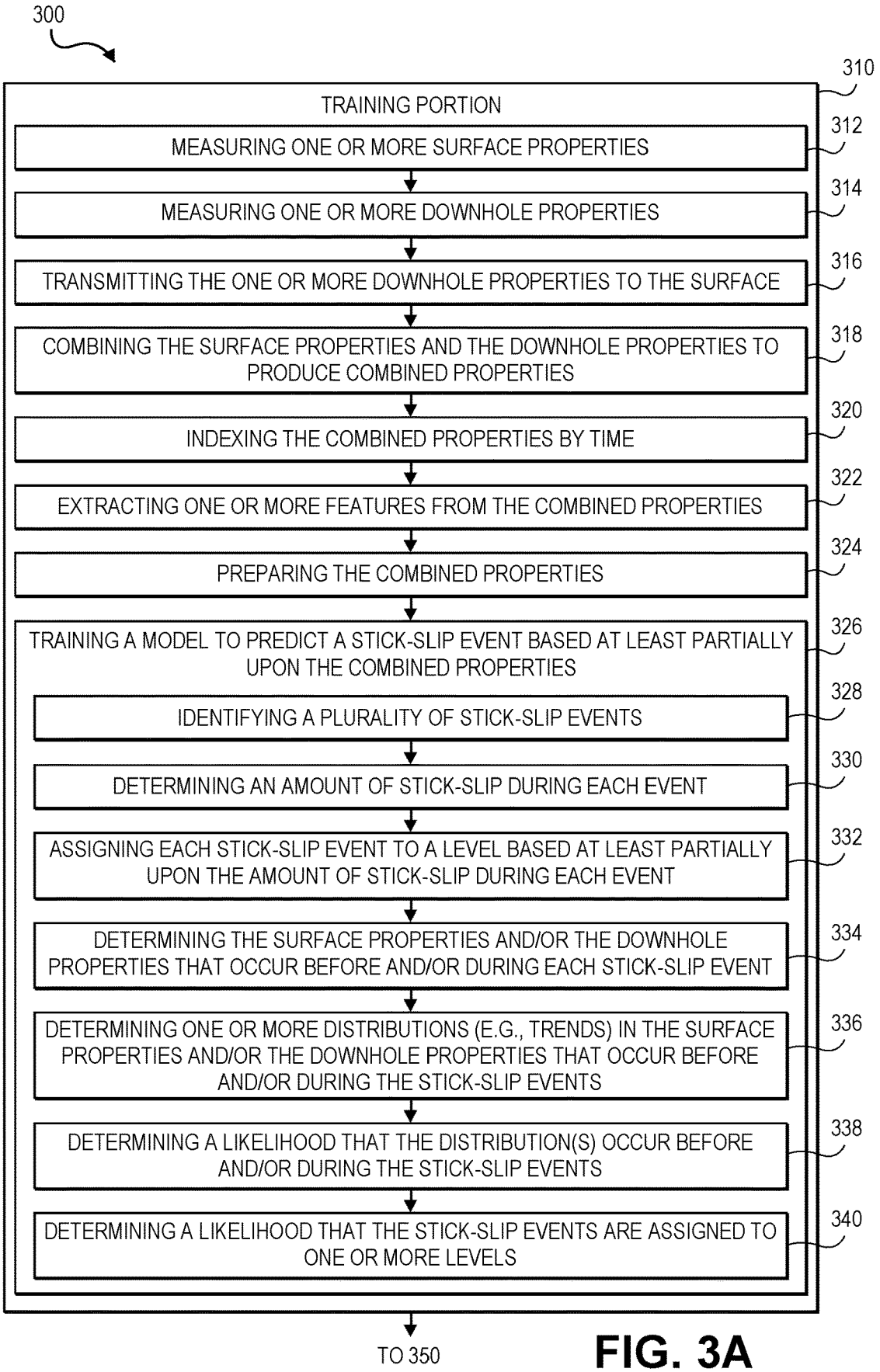
FIGS. 3A and 3B illustrate a flowchart of a method for predicting stick-slip, according to an embodiment.
Figure 3B:
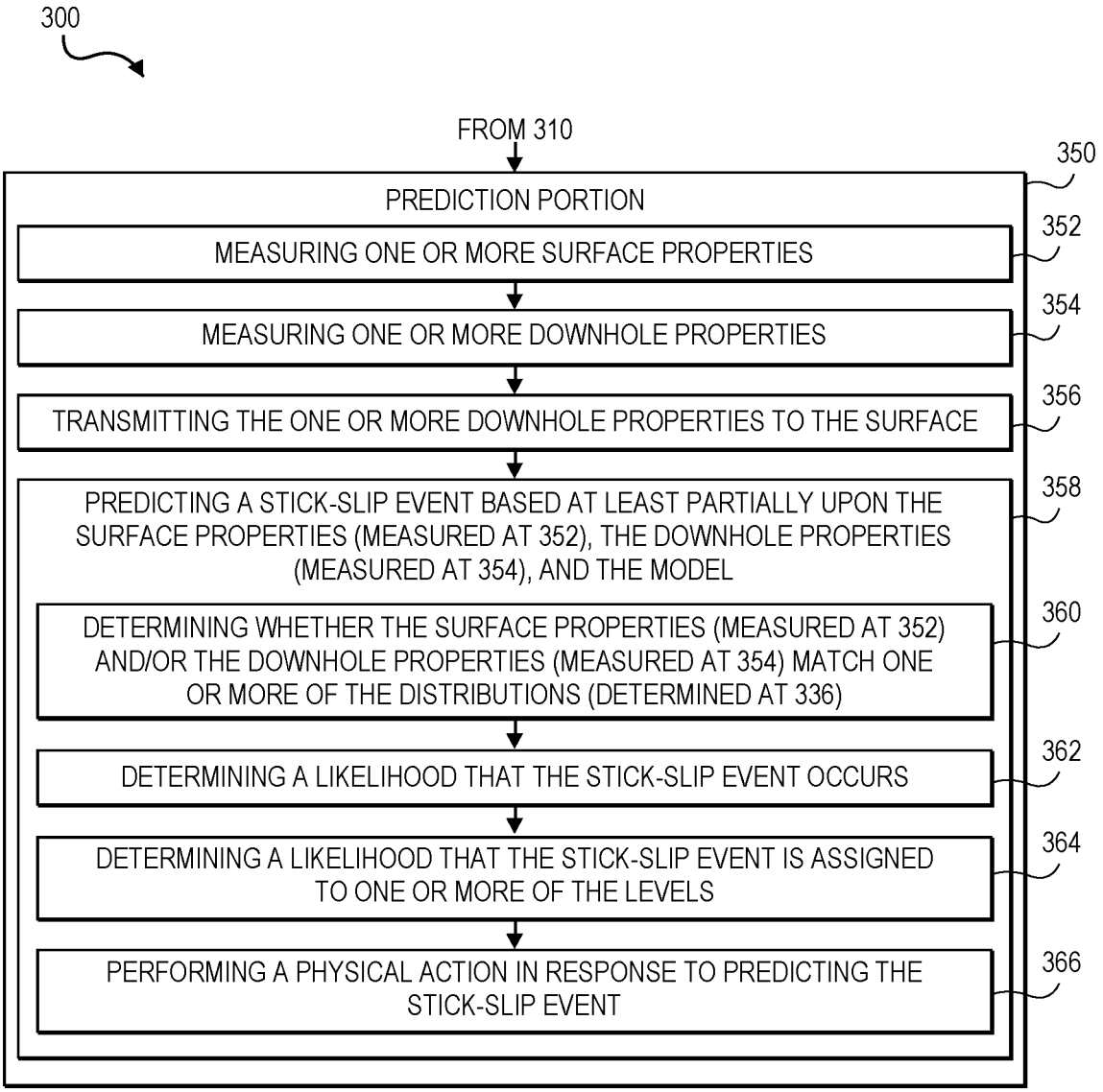

FIGS. 3A and 3B illustrate a flowchart of a method 300 for predicting stick-slip, according to an embodiment. An illustrative order of the method 300 is described below; however, as will be appreciated, one or more portions of the method 300 may be performed in a different order or omitted. The method 300 may include a training portion 310 and a predicting portion 350.

Training Portion 310

The training portion 310 of method 300 may include measuring one or more surface properties, as at 312. The surface properties may be measured at the surface. For example, the surface properties may include the surface physical properties measured by one of the surface sensors 240. An illustrative list of examples of the surface properties is provided above.

The training portion 310 of method 300 may also include measuring one or more downhole properties, as at 314. The downhole properties may be measured in the wellbore 220. For example, the downhole properties may include the downhole physical properties measured by the MWD tool 252 and/or downhole formation properties measured by the LWD tool 254. Illustrative lists of the downhole physical properties and the downhole formation properties are provided above.

The training portion 310 of method 300 may also include transmitting the one or more downhole properties to the surface, as at 316. For example, the downhole tool 250 may transmit encoded data representing the measured downhole properties to the surface using mud pulse telemetry or electromagnetic (EM) telemetry or other communication techniques.

The training portion 310 of method 300 may also include combining the surface properties and the downhole properties to produce combined properties, as at 318. For example, the surface properties and the downhole properties may be combined in a computing system 500 at the surface, which is described in greater detail below with respect to FIG. 5.

The training portion 310 of method 300 may also include indexing the combined properties by time, as at 320. For example, a first of the properties (e.g., torque on the upper portion of the drill string 230 at the surface) may be measured every second, and a second of the properties (e.g., the rate of rotation of the downhole tool 250) may be measured every 30 seconds. Indexing these properties may include interpolating (e.g., averaging) the second property to predict values at the same time intervals as the first property (e.g., every second). It may also or instead include selecting one out of every 30 readings of the first property.

The training portion 310 of method 300 may also include extracting one or more features from the combined properties, as at 322. The one or more features may be extracted before or after the surface properties and the downhole properties are combined, and/or before or after the combined properties are indexed. As used herein, the term "features" may refer to an individual measurable property or characteristic of a phenomenon being observed. Thus, examples of features may include time series moment calculations, vertical stand extractions, sliding time windows, and the like.

The training portion 310 of method 300 may also include preparing the combined properties, as at 324. The combined properties may be prepared before or after the surface physical properties and the downhole properties are combined, before or after the combined properties are indexed, and/or before or after the features are extracted from the combined properties. In at least one embodiment, preparing the combined properties may include determining whether the combined properties are within a predetermined range. For example, the predetermined range for the rate of rotation of the downhole tool 250 may be from 0 RPM to about 200 RPM. Rates outside of this range may be identified as unrealistic, and thus erroneous, and may be discarded. In another embodiment, preparing the combined properties may be or include bit-on-bottom recordings, slips data, RPM data, or CRPM data.

The training portion 310 of method 300 may also include training a machine learning (ML) model to predict a stick-slip event (e.g., involving the drill string 230 and/or downhole tool 250) based at least partially upon the combined properties, as at 326. The model may be or include a neural network. The model may be trained before or after the surface physical properties and the downhole properties are combined, before or after the combined properties are indexed, before or after the features are extracted from the combined properties, and/or before or after the combined properties are prepared.

In at least one embodiment, training the model may include identifying a plurality of previously-detected stick-slip events, as at 328. For example, more than 100, more than 1000, or more than 10,000 previously-detected stick-slip events may be identified and used to train the model. A starting time and an ending time may be identified for each previously-detected stick-slip event.

Training the model may also include determining an amount of stick-slip during each previously-detected event, as at 330. The amount of stick-slip may be represented by a difference between a maximum number of rotations per minute (RPM) and a minimum number of RPM. The maximum and minimum number(s) of RPM may be determined at the surface (e.g., as part of the surface properties) and/or downhole (e.g., as part of the downhole properties).

Figure 4:
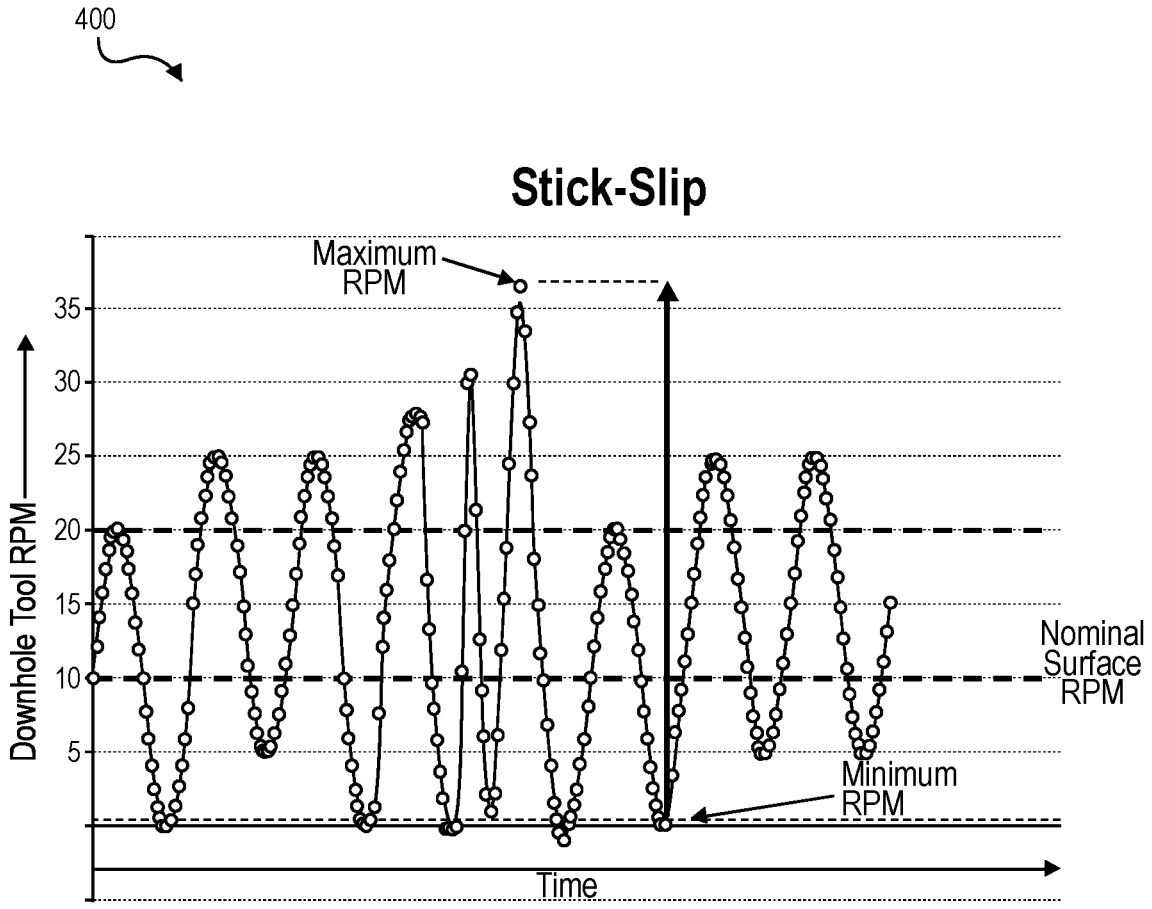
FIG. 4 illustrates a graph showing the rate of rotation of the downhole tool versus time during a stick-slip event, according to an embodiment.

FIG. 4 illustrates a graph 400 showing the rate of rotation of the downhole tool 250 versus time during a stick-slip event, according to an embodiment. As may be seen, the minimum is about 0 RPM, and the maximum is about 35 RPM. Thus, in this example, the amount of the stick-slip is about 35 RPM. A percentage of stick-slip may be determined by dividing the stick-slip amount by a nominal surface RPM. In this example, the nominal surface RPM is about 10 RPM. Thus, the percentage of stick-slip is 350%, which means that the lower portion of the drill string 230 and/or downhole tool 250 may be rotating as much as 3.5 times faster than the rotational speed that is imparted to the upper portion of the drill string 230 by the rig 210.

Training the model may also include assigning each previously-detected stick-slip event to a level based at least partially upon the amount of stick-slip during each previously-detected event, as at 332. In an example, the levels may include:

Level 1 (light) with an amount of stick-skip from 0.1 RPM to 5 RPM

Level 2 (medium) with an amount of stick-skip from 5 RPM to 15 RPM

Level 3 (heavy) with an amount of stick-skip from 15 RPM to 30 RPM

Level 4 (severe) with an amount of stick-skip from greater than 30 RPM

Thus, in the example above, where the amount of stick-slip is 35 RPM, this particular stick-slip event may be classified as Level 4 (severe). Table 1 below shows data for a plurality of events.

TABLE 1

| Event | Amount of SS | Level |
|---|---|---|
| 1 | 35 RPM | 4 (severe) |
| 2 | 11 RPM | 2 (medium) |
| 3 | 17 RPM | 3 (heavy) |
| 4 | 4 RPM | 1 (light) |

In another embodiment, rather than quantifying the amount of stick-slip by a number of RPMs, as in Table 1 above, the amount may also or instead be quantified by a percentage of stick-slip. For example, the level may be light when the stick-slip is 0%-40%, the level may be medium when the stick-slip is 40%-80%, the level may be heavy when the stick-slip is 80%-100%, and the level may be sever when the stick-slip is 100+%.

Training the model may also include determining the surface properties and/or the downhole properties that occur before and/or during each previously-detected stick-slip event, as at 334. In at least one embodiment, the surface properties and the downhole properties may be determined during a predetermined time before each previously-detected stick-slip event begins (e.g., from 5 minutes before the stick-slip event begins until the stick-slip event begins). In another embodiment, the surface properties and the downhole properties may be determined during a predetermined distance/depth before each previously-detected stick-slip event begins (e.g., from 5 meters above where the stick-slip event begins until where the stick-slip event begins). The surface properties and the downhole properties may also or instead be determined while each previously-detected stick-slip event occurred (e.g., between the start time and end time of each previously-detected stick-slip event).

Training the model may also include determining one or more distributions (e.g., patterns or trends) in the surface properties and/or the downhole properties that occur before and/or during the previously-detected stick-slip events, as at 336. As used herein, a distribution may refer to a mathematical expression that describes the probability that a system will take on a specific value or set of values. For example, the distribution may be or include a plurality of surface properties and/or downhole properties that are common between two or more previously-detected stick-slip events.

For example, the computing system 500 may analyze the properties and determine that two or more of the previously-detected stick-slip events occurred when:

The rate of rotation imparted to the upper portion of the tubular string 230 by the rig 210 is between a first value (e.g., 5 RPM) and a second value (e.g., 10 RPM);

The torque exerted on the upper portion of the tubular string 230 by the rig 210 is between a first value (e.g., 100 N*m) and a second value (e.g., 120 N*m);

The pressure measured by the downhole tool 250 is between a first value (e.g., 33 kPa) and a second value (e.g., 47 kPa); and The resistivity measured by the downhole tool 250 is between a first value (e.g., 7 Ω*m) and a second value (e.g., 12 Ω*m).

It will be appreciated that this is merely one example, and other distributions (e.g., combinations of selected measured parameters) may be used to perform this portion of the method 300.

Training the model may also include determining a likelihood that a distribution occurs before and/or during the previously-detected stick-slip events, as at 338. In an example, the computing system 500 may determine that a previously-detected stick-slip event occurred 15% of the time when the above distribution is detected. Thus, in this example, no stick-slip event occurred 85% of the time that the above distribution is detected. In at least one embodiment, a plurality of different distribution may be determined, and each distribution may have a different likelihood that the stick-slip events occur.

Training the model may also include determining a likelihood that the stick-slip events that occurred in response to the distribution(s) are assigned to one or more of the levels, as at 340. For example, there may be 20 stick-slip events that occurred when the above distribution is detected, and 8 of the stick-slip events may be level 1 (light), 7 of the stick-slip events may be level 2 (medium), 3 of the stick-slip events may be level 4 (heavy), and 1 of the stick-slip events may be level 4 (severe). Thus, there may be a 15% chance that a stick-slip event occurs when the above distribution is detected, and if an event occurs when the above distribution is detected, there may be a 40% likelihood that the event is level 1 (light), a 35% likelihood that the event is level 2 (medium), a 20% likelihood that the event is level 3 (heavy), and a 5% likelihood that the event is level 4 (severe).

Predicting Portion 350

The predicting portion 350 of the method 300 may include measuring one or more surface properties, as at 352. The predicting portion 350 of the method 300 may also include measuring one or more downhole properties, as at 354. The predicting portion 350 of the method 300 may also include transmitting the one or more downhole properties to the surface, as at 356. The portions 352, 354, and/or 356 may be similar to the portions 312, 314, 316 described above; however, the portions 352, 354, and/or 356 may occur at a later time. For example, the portions 352, 354, and/or 356 may occur after the training portion 310 is at least partially complete. Thus, in one embodiment, the properties measured at 312, 314 may be referred to as first properties (e.g., first surface properties 312 and first downhole properties 314), and the properties measured at 352, 354 may be referred to as second properties (e.g., second surface properties 352 and second downhole properties 354).

The predicting portion 350 of the method 300 may also include predicting a stick-slip event based at least partially upon the surface properties (measured at 352), the downhole properties (measured at 354), and the model, as at 358.

Predicting the stick-slip may include determining whether the surface properties (measured at 352) and/or the downhole properties (measured at 354) match one or more of the distributions (determined at 336), as at 360. The determination may be based upon the model or using the model. In one embodiment, the model may identify relationships between the features and the outputs (e.g., stick-slip events). One or more models may be trained/used to identify different relationships. The model may not be a rule-based model. Thus, the model may not explicitly look at patterns. In other words, the model may be trained to learn distributions and not explicit patterns.

For example, the surface properties (measured at 352) and/or the downhole properties (measured at 354) may match the distribution above when the rate of rotation imparted to the upper portion of the tubular string 230 by the rig 210 is 7 RPM, the torque exerted on the upper portion of the tubular string 230 by the rig 210 is 110 N*m, the pressure measured by the downhole tool 250 is 34 kPa, and resistivity measured by the downhole tool 250 is 11 Ω*m. In at least one embodiment, the surface properties (measured at 352) and/or the downhole properties (measured at 354) may match two or more of the distributions.

If the surface properties (measured at 352) and/or the downhole properties (measured at 354) match one or more of the distributions, then a likelihood of the stick-slip event occurring may be determined, as at 362. The likelihood of the stick-slip event occurring may be determined based upon the model or using the model. More particularly, the likelihood of the stick-slip event occurring may be determined based upon the particular distribution(s) that is/are matched, and the likelihood of the particular distribution(s) leading to a stick-slip event (as determined above at 338). For example, if the surface properties (measured at 352) and/or the downhole properties (measured at 354) match the distribution described above (at 336), then it may be determined that there is a 15% chance that the stick-slip event will occur. More particularly, there is a 15% chance that the stick slip event will occur within the predetermined time (e.g., within the next 5 minutes) and/or with the predetermined distance/depth (e.g., within the next 5 meters).

In addition, if the surface properties (measured at 352) and/or the downhole properties (measured at 354) match one or more of the distributions, then a likelihood that the stick-slip event is assigned to one or more of the levels may be determined, as at 364. The likelihood that the stick-slip event is assigned to one or more of the levels may be determined based upon the model or using the model. More particularly, likelihood that the stick-slip event is assigned to one or more of the levels may be determined based upon the particular distribution(s) matched (as determined above at 340). For example, if the surface properties (measured at 352) and/or the downhole properties (measured at 354) match the distribution described above (at 336), then it may be determined that there is a 15% chance that the stick-slip event will occur, and if the stick-slip event occurs, there is a 40% likelihood that it will be level 1 (light), a 35% likelihood that it will be level 2 (medium), a 20% likelihood that it will be level 3 (heavy), and a 5% likelihood that it will be level 4 (severe).

The predicting portion 350 of the method 300 may also include performing a physical action in response to predicting the stick-slip event, as at 366. For example, the physical action may be performed in response to the surface properties (measured at 352) and/or the downhole properties (measured at 354) matching one or more of the distributions (as determined at 360). The physical action may also or instead be performed in response to the likelihood of the stick-slip event occurring (as determined at 362) being greater than a predetermined threshold (e.g., 20%). The physical action may also or instead be performed in response to the likelihood of the level of the stick-slip event (as determined at 364) being greater than or equal to a predetermined level (e.g., greater than or equal to level 2) being greater than a predetermined threshold (e.g., 50%). In the example above, there is a 60% chance that the stick-slip event will be level 2-level 4; thus, as 60% is greater than the predetermined threshold of 50%, the physical action may be performed.

The physical action may be or include varying (e.g., decreasing) the rate of rotation imparted to the upper portion of the tubular string 230 by the rig 210, varying (e.g., decreasing) the torque exerted on the upper portion of the tubular string 230 by the rig 210, varying (e.g., decreasing) the weight on the drill bit 256, varying a trajectory of the downhole tool 250 in the wellbore 220, or a combination thereof. For example, the physical action may be selected to change one or more of the physical properties (measured at 352) and/or the downhole properties (measured at 354) such that they no longer match any of the distributions.

In at least one embodiment, the prediction portion 350 of the method 300 may be used to further train (e.g., tune) the model in the training portion 310 of the method 300 to increase the accuracy of the model for future iterations.

Figure 5:
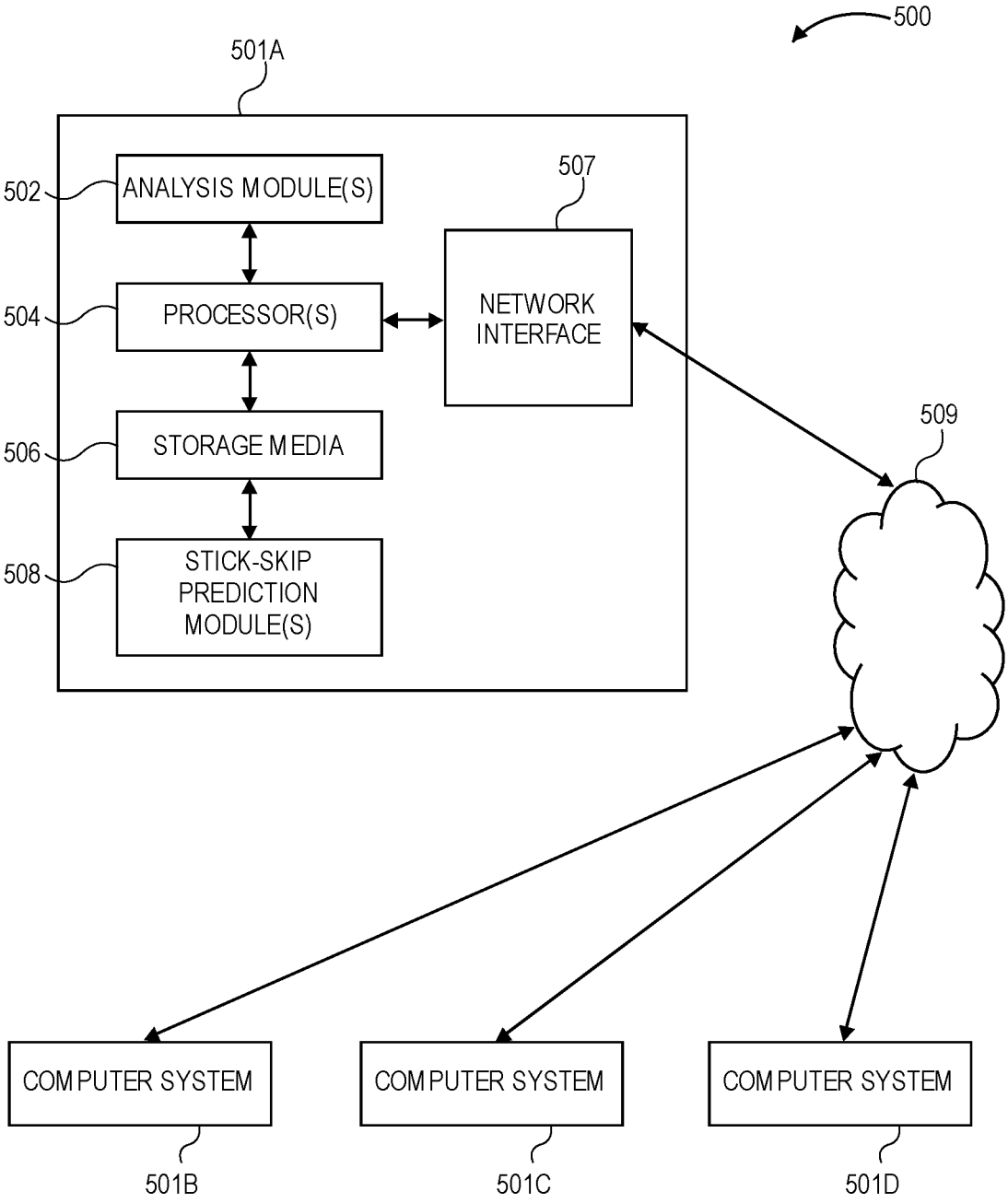
FIG. 5 illustrates a schematic view of a computing system for performing at least a portion of the method, according to an embodiment.

In some embodiments, the methods of the present disclosure may be executed by a computing system. FIG. 5 illustrates an example of such a computing system 500, in accordance with some embodiments. The computing system 500 may include a computer or computer system 501A, which may be an individual computer system 501A or an arrangement of distributed computer systems. The computer system 501A includes one or more analysis modules 502 that are configured to perform various tasks according to some embodiments, such as one or more methods disclosed herein. To perform these various tasks, the analysis module 502 executes independently, or in coordination with, one or more processors 504, which is (or are) connected to one or more storage media 506. The processor(s) 504 is (or are) also connected to a network interface 507 to allow the computer system 501A to communicate over a data network 509 with one or more additional computer systems and/or computing systems, such as 501B, 501C, and/or 501D (note that computer systems 501B, 501C and/or 501D may or may not share the same architecture as computer system 501A, and may be located in different physical locations, e.g., computer systems 501A and 501B may be located in a processing facility, while in communication with one or more computer systems such as 501C and/or 501D that are located in one or more data centers, and/or located in varying countries on different continents).

A processor may include a microprocessor, microcontroller, processor module or subsystem, programmable integrated circuit, programmable gate array, or another control or computing device.

The storage media 506 may be implemented as one or more computer-readable or machine-readable storage media. Note that while in the example embodiment of FIG. 5 storage media 506 is depicted as within computer system 501A, in some embodiments, storage media 506 may be distributed within and/or across multiple internal and/or external enclosures of computing system 501A and/or additional computing systems. Storage media 506 may include one or more different forms of memory including semiconductor memory devices such as dynamic or static random access memories (DRAMs or SRAMs), erasable and programmable read-only memories (EPROMs), electrically erasable and programmable read-only memories (EE- PROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 500 contains one or more stick-slip prediction module(s) 508 configured to perform at least a portion of the method 300. It should be appreciated that computing system 500 is merely one example of a computing system, and that computing system 500 may have more or fewer components than shown, may combine additional components not depicted in the example embodiment of FIG. 5, and/or computing system 500 may have a different configuration or arrangement of the components depicted in FIG. 5. The various components shown in FIG. 5 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 500, FIG. 5), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. A method for controlling drilling equipment in a wellbore using a stick-slip event prediction, the method comprising:

inputting measurements of one or more surface properties and measurements of one or more downhole properties to a computing system running a trained stick-slip prediction model;

determining, using the trained stick-slip prediction model at the computing system, that the one or more surface properties and the one or more downhole properties match a predetermined distribution, wherein:

the predetermined distribution comprises a distribution previously measured before two or more previously detected stick-slip events; and each of the two or more previously detected stick-slip events is assigned to a first stick-slip severity level or a second stick-slip severity level in the trained stick-slip prediction model;

determining, using the trained stick-slip prediction model at the computing system, a likelihood that a stick-slip event will occur based on the predetermined distribution; and varying at least one of: a rate of rotation of a portion of a tubular string in the wellbore, a weight on a drill bit in the wellbore, a trajectory of a downhole tool in the wellbore or a force exerted on the downhole tool in response to the likelihood that the stick-slip event will occur exceeding a first predetermined threshold and in response to a likelihood that the stick-slip event is assigned to the second stick-slip severity level exceeding a second predetermined threshold.

2. The method of claim 1, wherein the one or more surface properties comprise the rate of rotation imparted to the tubular string, a torque exerted on the tubular string, the weight on a drill bit, and a depth of the drill bit, and wherein the one or more downhole properties comprise a pressure, a temperature, the wellbore trajectory, a rate of rotation of the downhole tool, a resistivity, a porosity, a sonic velocity, and gamma ray data.

3. The method of claim 1, wherein determining the likelihood that the stick-slip event will occur comprises determining the likelihood that the stick-slip event will occur within a predetermined time after the one or more surface properties are measured, the one or more downhole properties are measured, or both.

4. The method of claim 1, wherein:

the first stick-slip severity level and the second stick-slip severity level each comprise a range from a lower stick-skip amount to an upper stick-slip amount; and the range of the second stick-slip severity level is greater than the range of the first stick-slip severity level.

5. The method of claim 1, wherein determining the likelihood that the stick-slip event will occur comprises determining the likelihood that the stick-slip event will occur within a predetermined distance from a location where the one or more downhole properties are measured.

6. The method of claim 1, further comprising determining, using the trained stick-slip prediction model at the computing system, a likelihood that the stick-slip event is assigned to the first stick-slip severity level or the second stick-slip severity level based on the predetermined distribution.

7. A method for predicting a stick-slip event, the method comprising:

training a stick-slip prediction model, wherein the training comprises:

receiving a measurement of one or more first surface properties;

receiving a measurement of one or more first downhole properties;

detecting a plurality of stick-slip events;

determining the one or more first surface properties and the one or more first downhole properties that occur before each of the detected plurality of stick-slip events;

determining a distribution in the one or more first surface properties and the one or more first downhole properties that occurs before two or more of the detected plurality of stick-slip events;

determining based on the detected plurality of stick-slip events a frequency that the distribution occurs before the detected plurality of stick-slip events;

assigning each of the detected plurality of stick-slip events to a first stick-slip severity level or a second stick-slip severity level in the trained stick-slip prediction model;

using the trained stick-slip prediction model to predict a stick-slip event, wherein using the trained stick-slip prediction model comprises:

receiving a measurement of one or more second surface properties;

receiving a measurement of one or more second downhole properties;

inputting the measurements of the one or more surface properties and the measurements of the one or more downhole properties to a computing system running the trained stick-slip prediction model;

determining, by the trained stick-slip prediction model, that the one or more second surface properties and the one or more second downhole properties match the distribution; and determining a likelihood that the stick-slip event will occur based on the distribution; and varying at least one of: a rate of rotation of a portion of a tubular string in a wellbore, a weight on a drill bit in the wellbore, a trajectory of a downhole tool in the wellbore or a force exerted on the downhole tool in response to the likelihood that the stick-slip event will occur exceeding a first predetermined threshold and in response to a likelihood that the stick-slip event is assigned to the second stick-slip severity level exceeding a second predetermined threshold.

8. The method of claim 7, wherein the first stick-slip severity level and the second stick-slip severity level each comprise a range from a lower stick-skip amount to an upper stick-slip amount, and wherein the range of the second stick-slip severity level is greater than the range of the first level.

9. The method of claim 7, wherein determining the likelihood that the stick-slip event will occur comprises determining the likelihood that the stick-slip event will occur as the determined frequency that the distribution occurs.

10. The method of claim 7, wherein using the trained stick-slip prediction model further comprises determining a likelihood that the stick-slip event is assigned to the first stick-slip severity level or the second stick-slip severity level based on the predetermined distribution.

11. A system for predicting a stick-slip event, the system comprising:

a sensor configured to measure one or more surface properties at the surface of a wellbore;

a downhole tool configured to measure one or more downhole properties of the wellbore; and a computing system configured to:

receive the one or more surface properties and the one or more downhole properties;

determine that the one or more surface properties and the one or more downhole properties match a predetermined distribution, wherein:

the predetermined distribution comprises a distribution previously measured before two or more previously detected stick-slip events; and each of the two or more previously detected stick-slip events is assigned to a first stick-slip severity level or a second stick-slip severity level in the stick-slip prediction model;

determine a likelihood that a stick-slip event will occur based on the predetermined distribution;

determine a likelihood that the stick-slip event is assigned to the first stick-slip severity level or the second stick-slip severity level based on the predetermined distribution; and vary at least one of: a rate of rotation of a portion of a tubular string in the wellbore, a weight on a drill bit in the wellbore, a trajectory of a downhole tool in the wellbore, or a force exerted on the downhole tool in response to the likelihood that the stick-slip event will occur exceeding a first predetermined threshold and in response to the likelihood that the stick-slip event is assigned to the second stick-slip severity level exceeding a second predetermined threshold.

12. The system of claim 11, wherein determining the likelihood that the stick-slip event will occur comprises determining the likelihood that the stick-slip event will occur within a predetermined time after the one or more downhole properties are measured.

13. The system of claim 11, wherein the first stick-slip severity level and the second stick-slip severity level each comprise a range from a lower stick-skip amount to an upper stick-slip amount.

14. The system of claim 13, wherein the range of the second stick-slip severity level is greater than the range of the first stick-slip severity level.

15. The system of claim 11, wherein determining the likelihood that the stick-slip event will occur comprises determining the likelihood that the stick-slip event will occur within a predetermined distance from a location where the one or more downhole properties are measured.

* * * * *